US005429526A

United States Patent [19]

Ann

[11] Patent Number: 5,429,526

[45] Date of Patent: Jul. 4, 1995

[54] WIRE CONNECTOR

[76] Inventor: Young S. Ann, 101-dong 5-ho, Garak 7th Hyundai Apt., 171-5 Garak 2 Dong, Songpa-Ku, Seoul, Rep. of Korea

[21] Appl. No.: 234,964

[22] Filed: Apr. 28, 1994

[30] Foreign Application Priority Data

Apr. 28, 1993 [KR] Rep. of Korea ..... 93-7235

[51] Int. Cl.[6] ..... H01R 4/24

[52] U.S. Cl. ..... 439/417; 439/347; 439/259; 439/725

[58] Field of Search ..... 439/395–405, 439/410, 411, 417–419, 725, 259, 347

[56] References Cited

U.S. PATENT DOCUMENTS

| | | | |
|---|---|---|---|
| 2,647,246 | 7/1953 | Gilbert | 439/419 |
| 2,720,635 | 10/1955 | Odegard | 439/418 |
| 2,884,555 | 4/1959 | Peterson | 439/419 |
| 4,047,785 | 9/1977 | Jayne | 439/398 |

*Primary Examiner*—David L. Pirlot

*Attorney, Agent, or Firm*—Andrus, Sceales, Starke & Sawall

[57] ABSTRACT

An electric connector suitable for establishing electrical connection between a wire and a mating connector or between a wire and another wire comprising: means forming a body, the means including contact means, the contact means having a first end for receiving a wire and a second end for making an electrical connection with the mating connector or for receiving another wire; plate means mountable on the body and forming a plurality of guide channels for wire and guide slots for receiving slidable cam means; means for retaining the plate means on the means forming a body; and slidable cam means slidably positioned in the receiving means, and slidable between a first position adjacent said means for piercing insulation and a second position remote therefrom, whereby a wire may be inserted into the guide channels when the cam means is in the second position and can be forced by said cam means into engagement with said means for piercing insulation on a wire by moving the cam means to the first position.

11 Claims, 5 Drawing Sheets

WIRE CONNECTOR

BACKGROUND OF THE INVENTION

1. Field of the Invention

The present invention relates to a wire connector for connecting a plurality of insulated wires with electric contact members for using in electronic circuits for electronic communication equipments.

2. Description of the Prior Art

The wire connectors are generally configured such that connection of a bundle of wires can be made in the form of pin-to-socket connection at the terminal ends thereof.

As illustrated in FIG. 1, a conventional wire connector 2 is shaped so that a partition wall 3 is positioned between the upper body 4 and the lower body 5. A plurality of partition walls 6 are formed with the bodies 4, 5, defining a plurality of separate cavities 11 in which electric contact members 7 made of a suitable metal such as copper are mounted. The conductive core of the insulated wire 8 and the electric contact member 7 can be electrically connected by pressing each insulated wire 8 into the projection 9 of the corresponding electric contact member 7. This causes a piercing of the insulation of the wire and gives rise to contact between the conductive metal core of the wire and the electric contact member at the projection 9. The pins 10 are inserted into the cavities 11 and connected to the terminal socket ends 12 of the electric contact members 7.

However, this type of conventional wire connectors have the disadvantage that the wires 8 must be connected by hand, one at a time, and there is no means for electrically and reliably connecting the insulated wires 8 to the electric contact members 7 and thereafter firmly maintaining the connection of the wires 8 and the electric contact members 7. Therefore, the electrical connection can easily fail. Also, in order to change or test for failed electrical connections or to test the circuits of the lines in the wire connector to be connected by the pin, the wire connector has to be disassembled and then the wire can be changed or be tested. This is a time consuming and inefficient operation. During disassembling and changing or testing the wire, the other wires 8 may be subjected to any external forces or a short circuit, and cross-talk of voices or noise in the lines may occurred. This may cause difficulties to other users.

Also, some users have required a wire connector to connect a wire to a wire, but there is no wire connector in the form of wire-to-wire connection in the prior art which provides secure, reliable connections as well as easy releasability for maintenance or testing.

SUMMARY OF THE INVENTION

Thus, an object of the present invention is to provide a wire connector which has wire press means for detachably connecting each wire to an electric contact member without failure of the electrical connections.

Also, another object of the present invention is to provide a wire connector in the form of wire-to-wire connection which has wire press means for detachably connecting two or more wire to each other through electric contact member.

According to the present invention, sliders are used as the wire press means and are slidably installed under the outer cover of the wire connector between the wire locking position in which the electrical connection of the wire and the electric contact member is made and the wire unlocking position in which electrical connection is open. The wire can be electrically connected to the electric contact member by inserting it into the inside of the wire connector so that it is positioned above the projection of the electric contact member, and sliding the slider into the wire locking position so that the insulation of the wire is pierced into the projection of the electric contact member. Therefore, the wire can be inserted into the wire connector and the electrical connection thereof can be made simply by sliding the slider from the outside of the wire connector without disassembling the wire connector and without opening other wires. Also, the wire can be removed from the electric contact member in the wire unlocking position by twisting it and pulling it out of the connector. Therefore, there is no need to disassemble the wire connector to change or inspect the wires, or to test the circuit to be connected by a pin.

In addition, a pair or multiple sliders may be wire press means and the electric contact member may be provided with multiple projections associated therewith to connect multiple wires. the wire press means and the projections can be arranged such that the wires are connected in axial alignment with each other connected. In such case, the wire connector has two connecting portions for mounting the wires, but may not have a socket portion. The electric contact member has no terminal socket ends but would have at least two projections, one at either end. Such a wire connector allows secure, releasable wire to wire connection.

The description of the present invention has been set forth schematically above, a preferred embodiment of the present invention is described below.

FIG. *7a* and *7b* are bottom views of the sliders.

DESCRIPTION OF THE EMBODIMENTS

With reference to FIGS. 2 to 5, the wire connector according to one embodiment of the present invention is shown. The wire connector comprises a main body 20, the slider guide plates 30, the outer covers 40, and the sliders 50.

Figure 1:
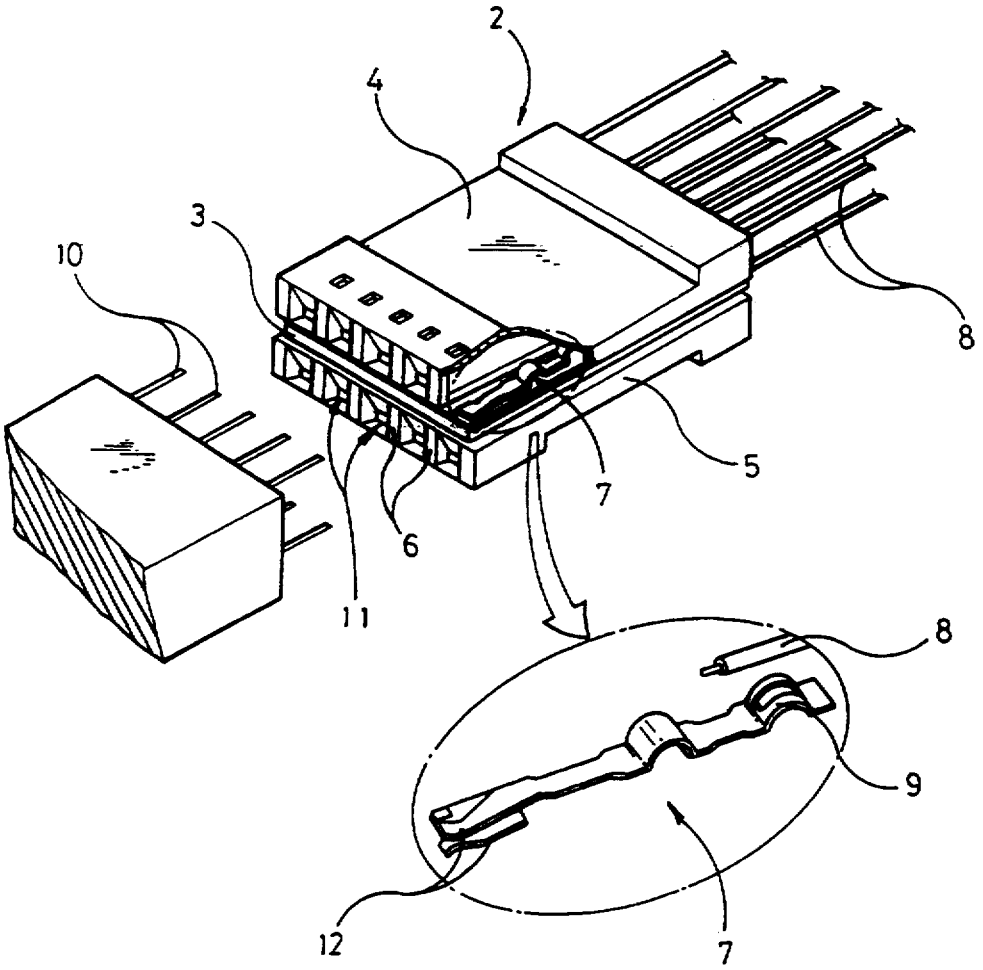
FIG. 1 is a perspective view of a conventional wire connector.
Figure 2:
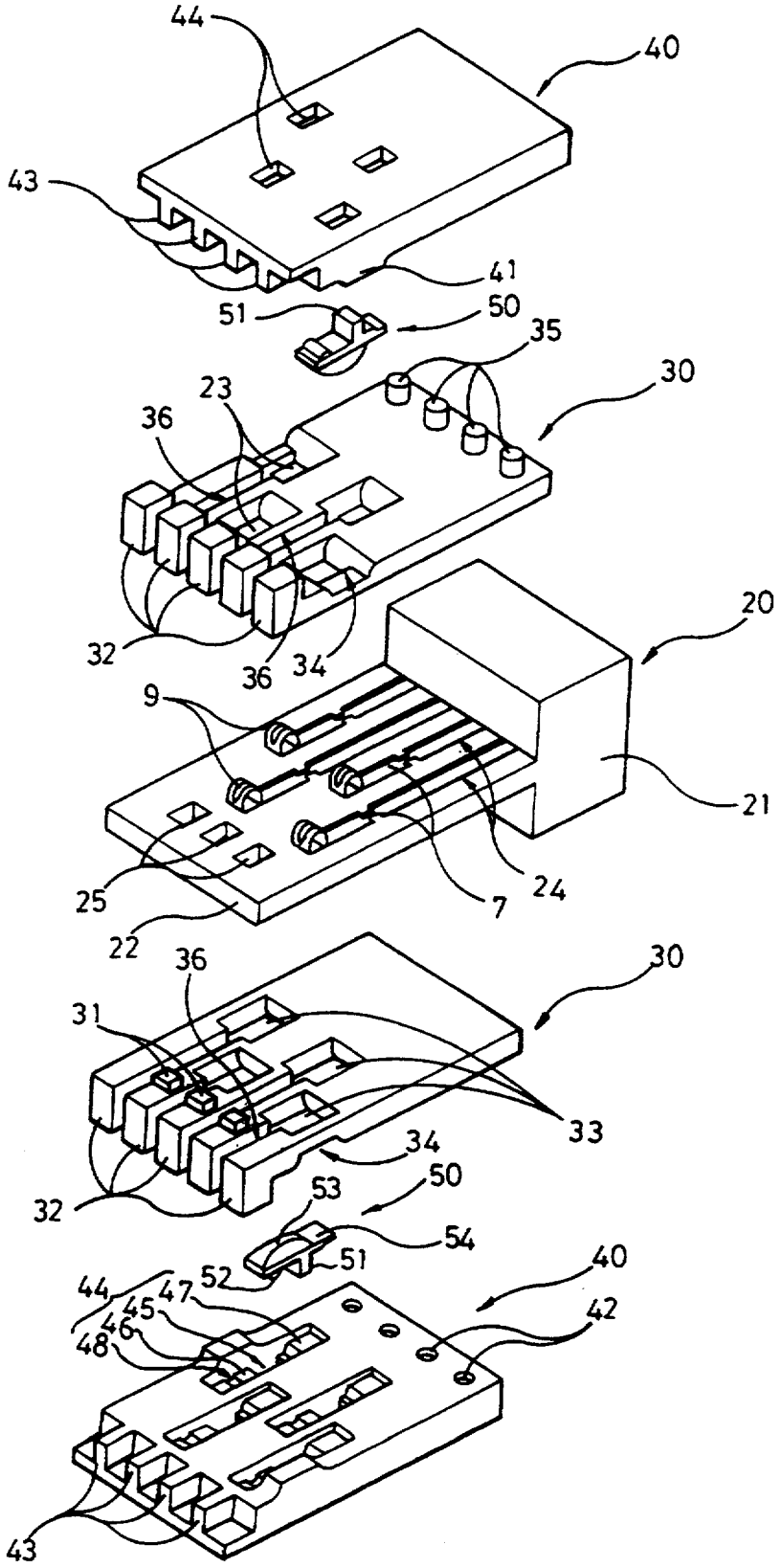
FIG. 2 is an exploded perspective view of the wire connector according to one embodiment of the present invention.

The main body 20 is provided with a socket portion 21 and a central plate 22. The socket portion 21 forms pin receiving cavities 23 in which the terminal socket ends 12 (See FIG. 1) of the electric contact member 7 is inserted. The upper and lower surfaces of the central plate 22 are formed with slots 24 for mounting the electric contact members 7. On the front of the central plate 22, holes 25 are formed which receive the protrusions 31 of the slider guide plate 30.

The slider guide plates 30 are mounted on both the upper and lower surfaces of the central plate 22 of the main body 20. The slider guide plates 30 do not move laterally from the central plate 22 because of the engagement of the protrusions 31 on the slider guide plates 30 with the holes 25 of the central plate 22. The slider guide plates 30 are also provided with holding blocks 32, slider seating holes 33 for receiving the sliders 50, concave portions 34 for receiving the walls 41 of the outer covers 40, and pins 35 which are engaged with holes 42 of the outer covers. Also, the channels 36 for inserting the wire 8 into the inside of the wire connector extend from the slider seating holes 33 between the holding blocks 32.

Figure 5:
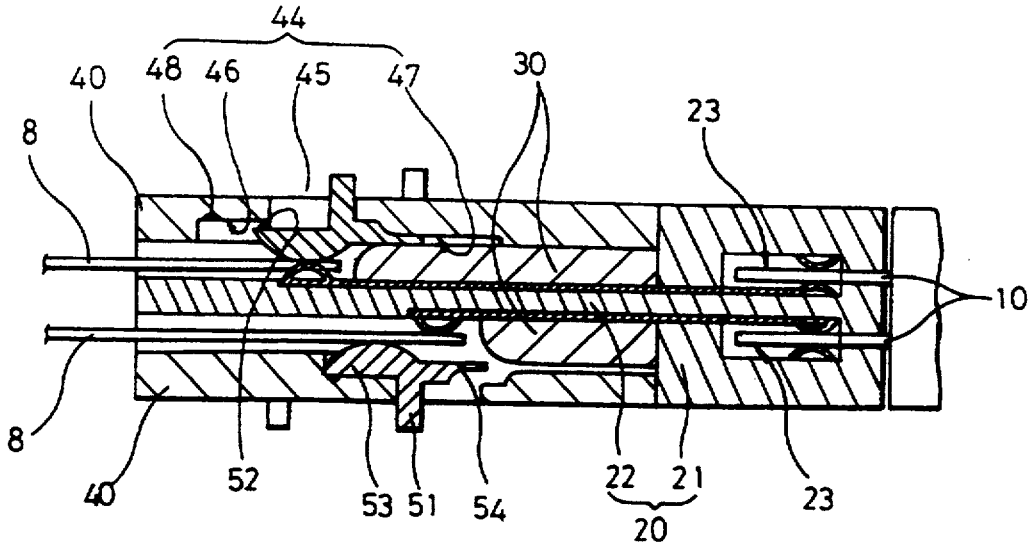
FIG. 5 is a sectional view of the ware connector showing the wire locking position and the wire unlocking position of the slider in the upper body and the lower body thereof, respectively.

The outer covers 40 are adapted to cover the slider guide plates 30. The outer covers 40 have walls 41, holes 42 which engage the pins 35 of the slider plates 30, partition walls 43, and slider slots 44 for receiving the tab 51 of the slider 50. Each partition wall 43 is inserted between the holding blocks 32 of the slider plates. Each slider slot 44 has a through hole portion 45, a first land portion 46, and a second land portion 47. On the first land portion 46 of the slider slot 44, a stop groove 48 is formed. As shown in FIG. 5, the second land portion 47 comprises a slanted surface and a flat surface which is formed lower than the surface of the inner surface of the outer cover 40 so that the tail portion 54 of the slider 50 can be engaged in the gap formed between the surface of the second land portion 47 of the outer cover 40 and the outer surface of the slider guide plate 30.

Each slider 50 is provided with a tab 51 and a stop 52 on one side, and a cam portion 53 and a flat tail portion 54 on the other side. A stop 52 is provided on the front side of the tab 51 and is engaged with the stop groove 48 of the slider slot 44 in the outer cover 40 when the slider 50 is in the wire unlocking position in with the cam portion 53 does not push the wire 8 toward the electric contact member 7. When the central plates 20 and the slider guide plates 30 are assembled, the cam portion 53 of the slider 50 is received to be able to be moved longitudinally within the slider seat hole 33, and the tab 51 of the slider 50 is projected through the slider slot 44 of the outer cover 40. Both sides of the cam portion 53 are tapered so that the cross sections thereof narrow toward the bottom surface which contacts the wire as shown in FIG. *7a*.

The methods for assembling the wire connector and connecting the insulated wire to the wire connector are explained below.

The electric contact members 7 are first mounted in slots 24 on the central plate 22 of the main body 20 so that each terminal socket end of the electric contact members 7 is received into the socket portion 21 of the main body 20.

Figure 3:
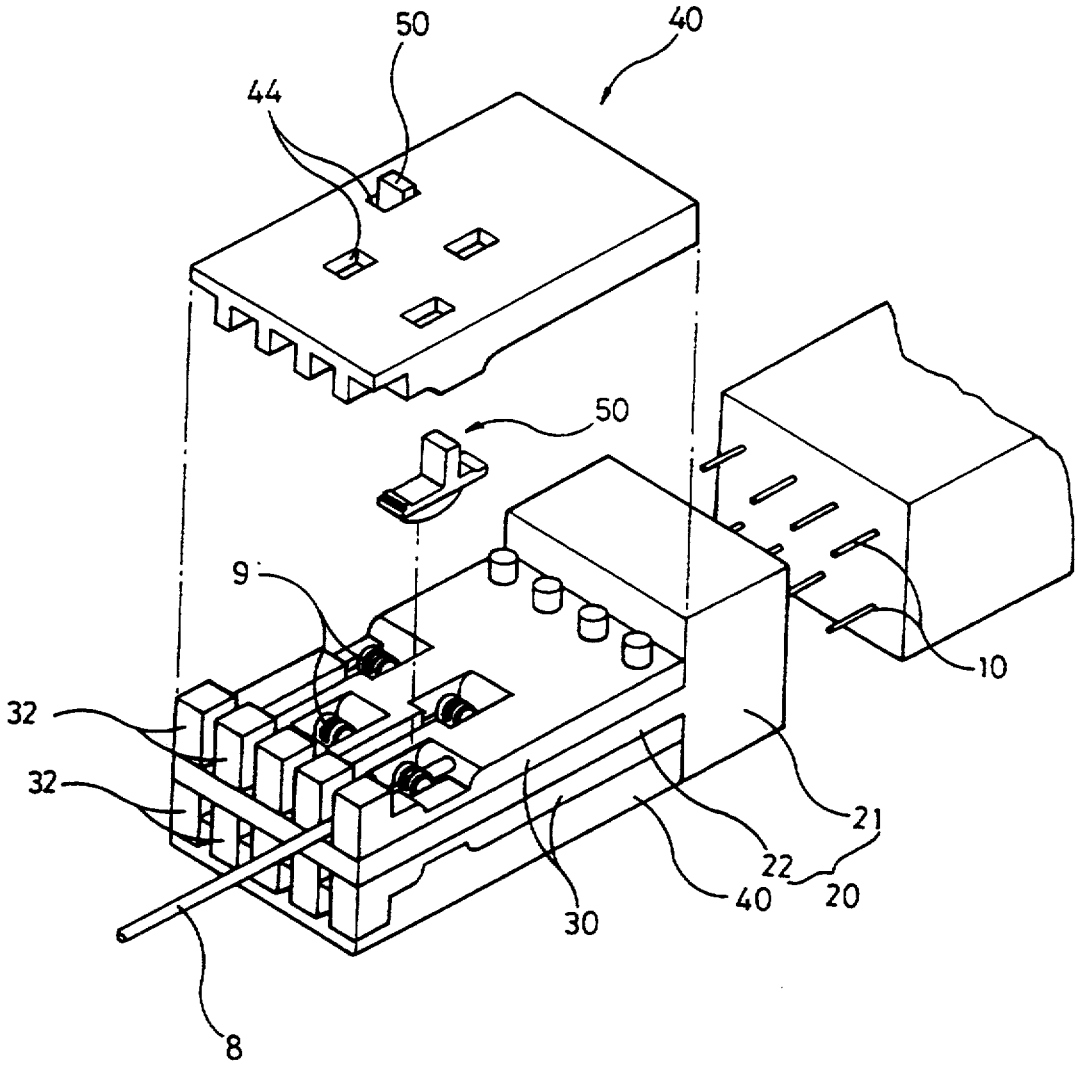
FIG. 3 is a partially exploded perspective view of FIG. 2 but with some of the components assembled.
Figure 4:
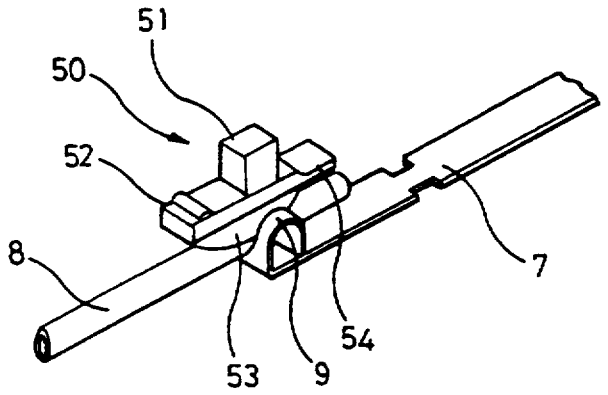
FIG. 4 is a perspective view of various elements of the wire connector of FIG. 2 showing the connection between a wire and an electric contact member resulting from the wire being pressed toward an electric contact member with a slider.

The slider guide plates 30 are mounted on the surfaces of the central plate 22 of the main body 20 so that the protrusions 31 of the slider guide plates 30 are engaged with the holes 25 on the central plate 22 of the main body 20 as shown in FIG. 3. In this situation, only the projections 9 of the electric contact members 7 are exposed from the slider guide plates 30 through the slider seating holes 33 as shown in FIG. 3.

Thereafter, each slider 50 is placed on the slider seating holes 33 in much a manner that the tab 54 is upwardly oriented.

Finally, the assembly of the wire connector is completed by mounting the outer covers 40 on the slider guide plates 30 so that the pins 35 of the slider guide plates 30 are engaged with the holes of the outer cover 40 and each partition wall 43 of the outer cover 40 is inserted between the holding blocks 32 of the slider guide plates 30. When the assembly is completed, the tabs 54 extend through the slide slots 44 of the outer cover 40 and protrude therefrom as shown in FIG. 5.

In order to connect the wire to the wire connector, especially the electric contact members 7 therein, the wire 8 is first inserted into the channel 36 which extends from the slider seating hole 33 between the holding blocks 32 of the slider guide plate 30 as shown in the lower half of FIG. 5. The wire 8 is positioned under the cam portion 53 of the slider 50 and will be laid on the projection 9 of the electric contact member 7. That is, the slider 50 is positioned in a wire unlocking position which the stop 52 of the slider 50 is engaged with and is locked to the stop groove 47 of the outer cover 40 but the insulation of the insulated wire 8 has not been completely pierced by the projection 9 of the electric contact member 7 and thus no electrical connection of the wire and the electric contact member 7 is made.

If the operator wants to electrically connect the wire to the electric contact member, this can be achieved by sliding the tab 51 of the slider 50 toward the socket portion 21 of the main body 20 in the direction as indicated by the arrow A in FIG. 5. The cam portion 53 of the slider 50 pushes the wire 8 down into the projection 9 of the electric contact member 7 and thus the insulation of the insulated wire 8 is completely pierced by the projection 9 of the electric contact member 7, thereby completing the electrical connection of the wire and the electric contact member 7. Also, as shown in a upper half of FIG. 5, the tail portion 54 of the slider 50 engages the gap formed between the surface of the second land portion 47 of the outer cover 40 and the outer surface of the slider guide plate 30, and the cam portion 53 of the slider 50 remains in the position pushing the wire 8 toward the projection 9 of the electric contact member 7. That is, the slider 50 is held firmly in the wire locking position so that the electrical connection is made between the wire 8 and the electric contact member 7. Thus, the wire is safely retained in the wire connector with improved reliability of the electrical connection.

In order to change a wire or test any failed electrical connection thereof or to test the circuits of the lines in the wire connector to be connected by the pin, the slider 50 for the related wire 8 is slid from the wire locking position as shown in the upper half of FIG. 5 to the wire unlocking position as shown in the lower half of FIG. 5. In this position the wire 8 can be removed from the projection of the electric contact member 7 by twisting it and pulling out it from the wire connector. Therefore, there is no need to disassemble the wire connector. This results in time savings compared with a convention wire connector, and reduces the likelihood of short circuits or cross-talk of voices or noise in the lines during any operations.

Figure 6:
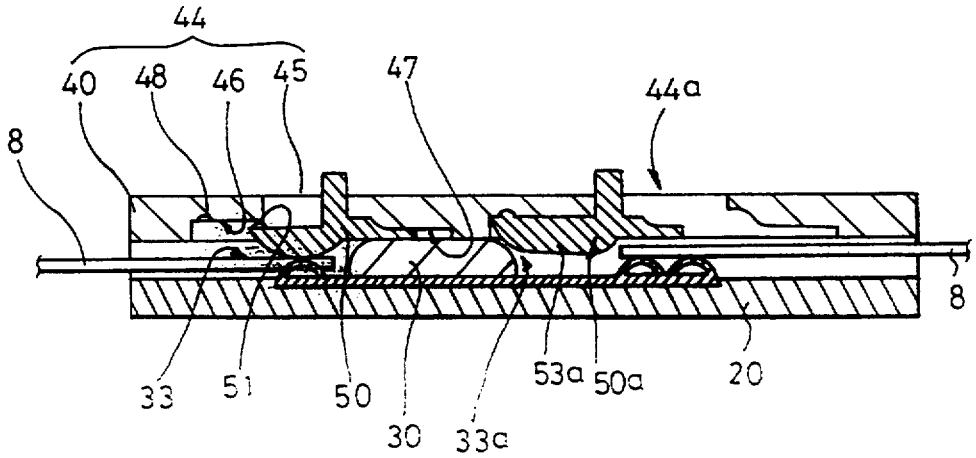
FIG. 6 is a sectional view of a wire connector useable for wire-to-wire connection in accordance with a second embodiment of the present invention.
Figure 7A:
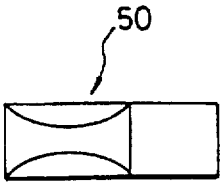
Figure 7B:
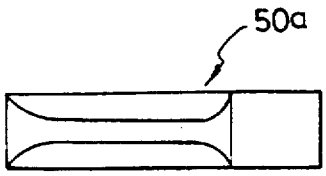

FIG. 6 shows the wire connector according to another embodiment of the present invention. The wire connector shown in FIG. 6 has the came constructions as part of the wire connector shown in FIGS. 2 to 6 except that the wire connector in FIG. 6 is adapted to connect two wires by means of an electric contact member, but does not have a socket portion as shown in FIGS. 2 to 5. That is, the wire connector according to this embodiment uses two sliders 50 and 50*a*. The main body 20 is in the form of a plate. The electric contact member has no terminal socket end but rather has a projection in the first end and a pair of projections in the second end (shown at the right of the figure). In order to push the wire down into the pair of projections at the same time, the slider 50*a* has a more flattened and elongated cam portion 53*a* which is different from that of the cam portion 53 of the slider 50, as shown in FIGS. *7a* and *7b*. Also, the lengths of the slider seating hole 33*a* and the slider slot 44*a* are longer than those of the slider seating hole 33 and the slider slot 44, respectively. The connection made by two projections is more secure and provides better electrical contact with the wire than that provided by a single projection. The connection of the wire to another wire can be easily made by the wire connector having the structure of this embodiment.

While the preferred embodiments of the present invention have been shown and described herein, such embodiments are provided by way of example only. Numerous variations, changes and substitutions will occur to those of skill in the art without departing from the invention herein. Accordingly, it is intended that the invention be limited only by the spirit and scope of the appended claims.

I claim:

1. An electric connector suitable for establishing electrical connection between a wire and a mating connector comprising;

means forming a body, said means including contact means, said contact means having a first end for receiving a wire and a second end for making an electrical connection with said mating connector, the first end of said contact means including means for piercing insulation on a wire;

plate means mountable on said body and forming a plurality of guide channels, said guide channels being adapted to allow insertion of a wire into said connector such that said wire contacts said contact means, said plate means further forming guide slots for receiving slidable cam means;

means for retaining said plate means on said means forming a body; and slidable cam means slidably positioned in said receiving means, and slidable between a first position adjacent said means for piercing insulation and a second position remote therefrom, whereby a wipe may be inserted into said guide channels when said cam means is in said second position and can be forced by said cam means into engagement with said means for piercing insulation on a wire by moving said cam means to said first position.

2. A wire connector for connecting a plurality of insulated wires with electric contact members, said electric contact members each having a terminal socket end to be connected with a pin and a projection to be connected with a wire, said wire connector comprising;

a main body comprising a socket portion having pin receiving cavities in which the terminal socket ends of the electric contact member are inserted respectively, and a central plate being formed with slots for mounting the electric contact members on upper and lower surfaces thereof respectively;

slider guide plates being mounted on the upper and lower surfaces of said central plate of the main body, and each said guide plate having slider seating holes for receiving each slidable cam means and channels for inserting each wire into the inside of the wire connector assembled;

outer covers being mounted to cover the slider guide plates respectively and each cover having slider slots for receiving a tab associated with the slidable cam means; and the slidable cam means being slidably installed under said each outer cover between a wire locking position in which the electrical connection of the wire and the electric contact member is made and a wire unlocking position which no electrical connection thereof is made.

3. A wire connector according to the claim 2, wherein each said slidable cam means comprises slider is provided with a tab and a stop on one side, and a cam portion and a flat tail portion on another side, and wherein each slider slot has a through hole portion, a first land portion having a stop groove, and a second land portion, whereby in the wire looking position the tail portion of the slider can be engaged between the surface of the second land portion and an outer surface of the slider guide plate, and the stop is engaged with the stop groove of the slider slot in the outer cover, and in the wire looking position the cam portion pushes the wire down into the projection of the electric contact member so that the insulation of the wire is pierced by the projection of the electric contact member and thus the electrical connection is made.

4. A wire connector according to the claim 3, wherein the sides of the cam portion are tapered inward toward one another so that the cross sections thereof narrow toward a bottom surface which contacts the wire.

5. A wire connector according to the claim 2, wherein the slider guide plates are provided with holding blocks, wherein the outer covers have partition walls, each partition wall being inserted between said holding blocks, and wherein the channels are extended from said slider seating holes between said holding blocks, respectively.

6. A wire connector according to claim 2 wherein the central plate of the main body is formed with holes on the front thereof, and the slider guide plates are provided with the protrusions which engage with said holes; and wherein the slider guide plates are provided with concave portions and pins, and the outer covers have walls which engage with said concave portions, and holes which engage said pins.

7. A wire connector for connecting a plurality of insulated wires with electric contact members for use in electronic circuits, said wire connector comprising:

electric contact members each having at least two projections and adapted to be connected with a wire adjacent opposed ends thereof;

a main body in the form of a plate being formed with slots for mounting the electric contact members on a surface thereof;

a slider guide plate mounted on the surface of the main body, and having slider seating holes for receiving sack slider and channels for inserting each wire into the inside of the wire connector assembled;

an outer cover being mounted to cover the slider guide plate and having slider slots for receiving the tab of the slider; and sliders being slidably mounted under said outer cover and movable between a wire locking position in which the electrical connection of the wire and the electric contact member is made and a wire unlocking position in which the wire may be removed.

8. A wire connector according to the claim 7, wherein the slide guide plate is provided with holding blocks in both sides, wherein the outer cover has partition walls in both sides, each partition wall being inserted between said holding blocks, and wherein the channels are extended from said slider seating holes between said holding blocks, respectively.

9. A wire connector according to the claim 7, wherein said body is formed with holes on the surface thereof, and the slider guide plate is provided with the protrusions which engage with said holes, and wherein the slide guide plate is provided with pins, and the outer cover has holes which engage said pins.

10. A wire connector according to the claim 7, wherein each said slider is provided with a tab and a stop on one side, and a cam portion and a flat tail portion on the other side, and the both sides of the cam portion are tapered so that the cross sections thereof are narrowed toward the bottom surface which contacts with the wire, wherein each slider slot has a through hole portion, a first land portion having a stop groove, and a second land portion, whereby in the wire locking position the tail portion of the slider can be engaged between the surface of the second land portion and the outer surface of the slider guide plate, and said stop is engaged with said stop groove of the slider slot in the outer cover, and in the wire locking position the cam portion pushes the wire down into the projection of the electric contact member so that the insulation of the wire is pierced by the projection of the electric contact member and the electrical connection is made.

11. A wire connector according to the claim 10, wherein electric contact member is formed to include at least two projections in each end, the bottom surface of said each cam portion associated with said each end is formed to be flat and elongated so that said cam portion pushes down and connects the wire simultaneously to said projections.

* * * * *

UNITED STATES PATENT AND TRADEMARK OFFICE

CERTIFICATE OF CORRECTION

PATENT NO. : 5,429,526

DATED : July 4, 1995

INVENTOR(S) : YOUNG SOOK ANN

It is certified that error appears in the above-identified patent and that said Letters Patent is hereby corrected as shown below:

Claim 1, Col. 5, Line 52, delete "wipe" and substitute therefor -- wire --; Claim 3, Col. 6, Line 24, delete "looking" and substitute therefor -- locking --; Claim 3, Col. 6, Line 29, delete "looking" and substitute therefor -- locking --; Claim 7, Col. 6, Line 66, delete "sack" and substitute therefor -- each --.

Signed and Sealed this

Third Day of October, 1995

*Attest:*

*Attesting Officer*

Bruce Lehman

BRUCE LEHMAN

*Commissioner of Patents and Trademarks*